United States Patent [19]

Brumfield

[11] 3,950,804

[45] Apr. 20, 1976

[54] COLLAPSIBLE RAFT

[76] Inventor: James W. Brumfield, 404 Benham St., Richland, Wash. 99352

[22] Filed: Nov. 27, 1974

[21] Appl. No.: 527,681

[52] U.S. Cl. ..... 9/2 C; 9/11 A

[51] Int. Cl.[2] ..... B63B 7/06

[58] Field of Search ..... 9/11 A, 11 R, 3, 4 R, 9/4 A, 2 R, 2 A, 2 C, 2 F

[56] References Cited

UNITED STATES PATENTS

| | | | |
|---|---|---|---|
| 637,940 | 11/1899 | Myers | 9/4 R X |
| 669,547 | 3/1901 | Patersson | 9/4 R |
| 2,642,590 | 6/1953 | Hermann | 9/2 A |
| 2,761,155 | 9/1956 | Headley | 9/11 A |
| 2,888,690 | 6/1959 | Shaw | 9/11 A |
| 3,037,218 | 6/1962 | Brooks | 9/11 A |
| 3,477,074 | 11/1969 | Bezanis | 9/11 A |
| R18,204 | 9/1931 | Straussler | 9/2 C |

*Primary Examiner*—Trygve M. Blix
*Assistant Examiner*—Gregory W. O'Connor
*Attorney, Agent, or Firm*—Wells, St. John & Roberts

[57] ABSTRACT

A collapsible raft includes opposed hinged rigid hull and deck members joined by a flexible watertight skirt and surrounded by a peripheral inflatable tube. The hinge plates interconnecting the hull and deck may be selectively locked in an open condition. In the preferred form, the hull and deck members each include a water sealable hatch and appropriately valved ventilator tubes that render the raft invertible and serve to protect the occupant(s) from drowning and exposure. A second form of the invention is embodied in a pleasure craft wherein the deck is open and includes a seating arrangement and provision for mounting an outboard motor.

7 Claims, 8 Drawing Figures

COLLAPSIBLE RAFT

BACKGROUND OF THE INVENTION

The present invention relates basically to water vessels and more particularly to water vessels that are collapsible to a compact storage or carrying condition.

It has long been desired to obtain or provide a seaworthy vessel that may be collapsed to a compact form for carrying and storage. Such vessels are especially useful as auxiliary craft in the form of life rafts or lifeboats carried by larger vessels. Normally, such auxiliary craft is provided either in the form of lifeboats which are not collapsible and therefore occupy a great deal of valuable space on the larger vessel, or they are supplied in the form of a rubberized life raft that is inflatable from a compact condition to an operative condition. Normally such inflatable rafts are upwardly open to receive the occupants. Other rafts such as those shown in U.S. Pat. No. 3,037,218 and No. 2,888,690 disclose inflatable life rafts that have roof structures defining an enclosure or shelter for occupants. Both designs are relatively complex in nature and obviously expensive to purchase and maintain. U.S. Pat. No. 3,037,218 teaches the ability to utilize either horizontal side as the hull. The structure however, is supported solely by inflated members, such members being the only means to provide flotation. U.S. Pat. No. 2,888,690 features the use of a watertight rigid frame constructed of wood or sheet metal that has a central main body portion, with outrigged flotation units. This raft is not invertible nor is it capable of being stowed in a relatively small area.

The apparatus of the present invention may be embodied in both an auxiliary lifesaving vessel or as a pleasure craft that may be collapsed and easily moved or stored. The apparatus includes two somewhat rigid panels that comprise the hull and deck. These panels are connected to one another by means of a plurality of peripheral hinges, and a peripheral watertight skirting. In addition to the flotation provided by the skirting, a peripheral toroidal tube is also mounted to the vessel periphery. This tube is inflatable and may be utilized to support the structure in an open occupant receiving condition and deflated to allow the two panels to come into an adjacent closed condition. The lifesaving embodiment is invertible, with the hull and deck being water sealable and provided with valves for air circulation.

It is a first object of the present invention to provide a collapsible raft that may be quickly transformed from a closed compact condition to an occupant receiving condition.

Another object is to provide such an apparatus that is very simple in construction and therefore easy to assemble and inexpensive to purchase.

A further object is to provide such a vessel that may be utilized easily as a pleasure craft as well as a lifesaving raft.

These and further objects and advantages will become apparent upon reading the following description which, taken with the accompanying drawings, disclose a preferred and alternate form of the present invention.

DETAILED DESCRIPTION OF A PREFERRED AND AN ALTERNATE EMBODIMENT

Figure 1:
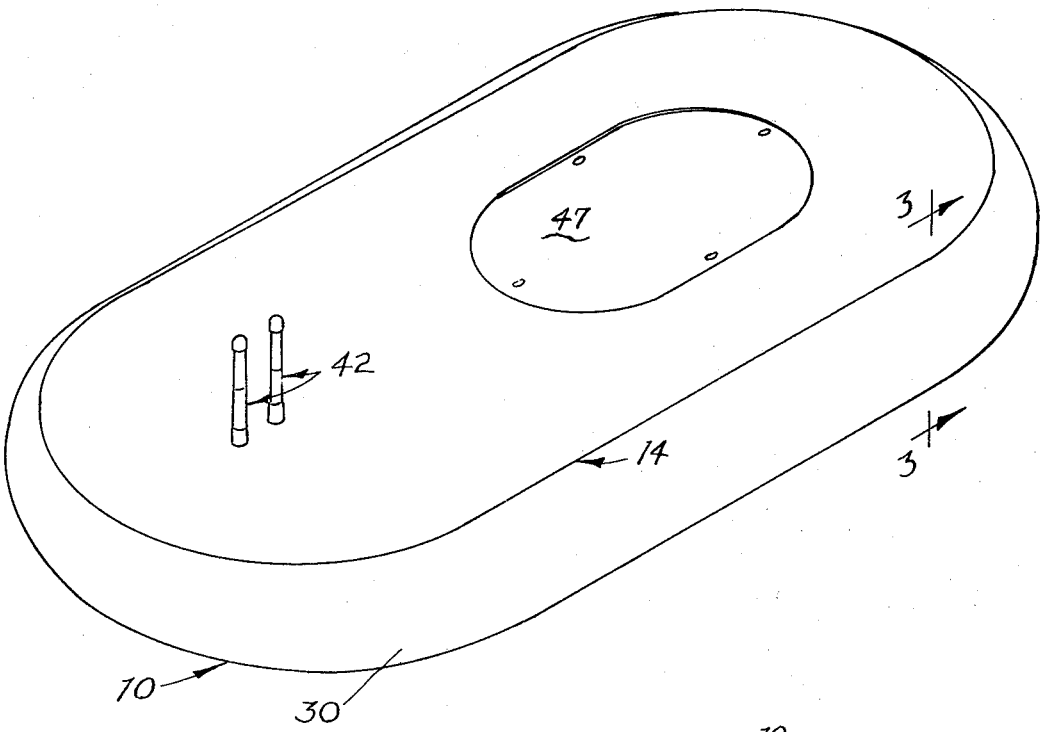
FIG. 1 is a pictorial view of the preferred form of the collapsible raft.
Figure 2:
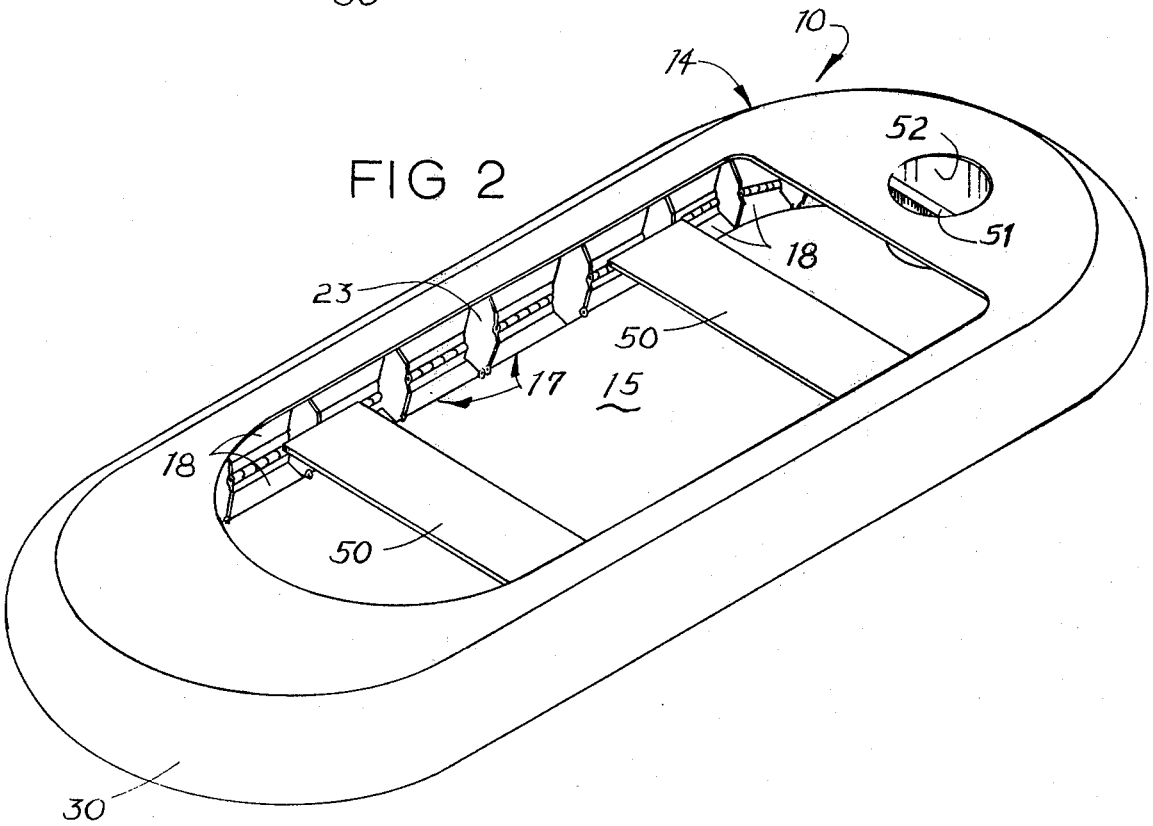
FIG. 2 is an alternate form of the collapsible raft structure.

Looking at the drawings in more detail, a preferred form of my invention is illustrated in FIG. 1. FIG. 2 illustrates an alternate form of my invention. Both FIGS. 1 and 2 illustrate a collapsible raft that is generally designated by the reference character 10. Basically, raft 10 is comprised of a rigid planar deck member 14 and an opposed rigid planar hull member 15. It should be noted that in the preferred form deck and hull members 14 and 15 are substantially identical. Thus, whichever side is "up" when the raft is afloat may be defined as the "deck" member 14 and whichever side is "down" in engagement with the water is defined as the "hull" member 15. In short, the preferred form of raft 10 is invertible and will float with equal ease on either member 14 or 15.

Figure 3:
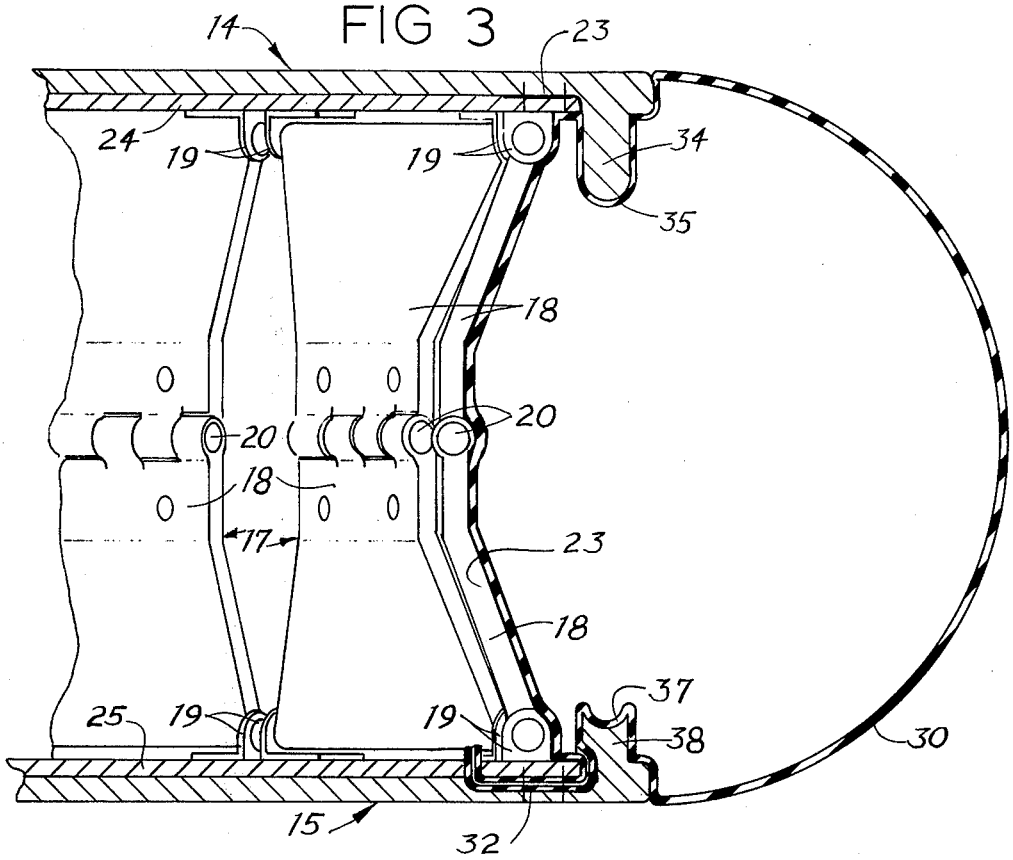
FIG. 3 is an enlarged sectional view taken substantially along line 3—3 in FIG. 1.
Figure 6:
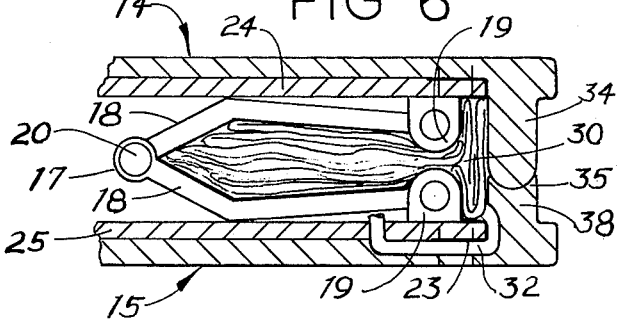
FIG. 6 is a cross sectional view similar to FIG. 3 only showing the collapsed condition of the apparatus.

Deck member and hull member 14 and 15 are connected by hinge means 17 that enable movement of the deck and hull members between a collapsed condition as partially shown in FIG. 6 and an expanded condition as shown in FIGS. 1, 2 and 3. Also included in the assembly is a flexible watertight skirt 23 that is connected between members 14 and 15, encompassing the deck and hull to provide a watertight enclosure for receiving occupants. A toroidal inflatable tube 30 is also provided at the exterior of water-tight skirt 23 to provide additional flotation, support between the panels, and to act as a shock absorber or bumper about the raft periphery. Also, the air space within the inflated tube acts as a heat insulator to protect the occupant(s) in cold weather.

Looking at the hinge structure in greater detail, reference will be made particularly to FIGS. 3 and 6. Hinge means 17 is comprised of a plurality of hinge plates 18 mounted about the periphery of deck and hull members 14 and 15. Hinge plates 18 are mounted to the respective members by pivot brackets 19. The hinge plates extend from pivot brackets 19 in opposed directions to join at pivot pins 20. It may be noted in FIG. 3 that the hinge plates 18 are somewhat trapezoidal in configuration with the dimension between pivot brackets 19 being greater than the dimension at pivot pins 20. This configuration allows the deck member and hull member to be moved to the collapsed condition as shown in FIG. 6 without the hinge plates 18 interferring with one another. Plates 18 are also bent near pivot pins 20 so that in the closed compact condition, the plates 18 are spaced apart to leave room for collapsed tube 30 and skirt 23.

Figure 8:
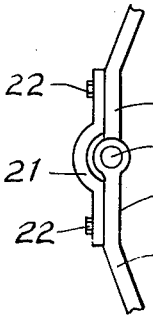
FIG. 8 is a fragmentary view illustrating means for locking the raft hinge means in an open expanded condition.

Means is provided to lock the hinge plates 18 in an open condition. This means is illustrated in FIG. 8 and is comprised of a locking plate 21 mounted to opposed hinge plates 18 by nuts or bolts 22. Plates 21 extend in opposite directions at least half the distance from the hinge axis to the hull and deck members to provide rigidity about the axis of pivot pins 20. Plates 21 therefore prevent the raft from returning to the compact condition regardless of the inflated condition of tube 30.

Flexible watertight skirt 23 is fixed about the periphery of the raft outside or exterior of the hinge plates 18. Skirt 23 is fixed between deck member 14 and hull member 15, encompassing the occupant receiving area. As may be noted in FIGS. 3 and 6, deck member 14 includes an inner panel 24 that is mounted to member 14 and faces hull member 15. An edge portion of skirt 23 is fitted between panel 24 and deck member 14 and fastened thereto by means of stitching or glue or other means to complete a watertight seal. The hull member 15 also includes an inner panel 25 that sandwiches an opposed edge portion of the watertight skirt 23 there between. Again an appropriate attachment such as stitching or glue is utilized to provide a watertight seal between skirt 23 and hull member 15.

Toroidal inflatable tube 30 is provided exterior of the water-tight skirt 23. Tube 30 provides secondary flotation for the raft since flotation may already by accomplished by the structure as described above without utilizing such an inflatable tube. Therefore, the tube 30 may be utilized to aid in holding the hull and deck members apart if the locking means is not utilized, provide a bumper or shock absorbing member at the raft periphery. Further, if required, the tube will provide sufficient buoyancy to maintain the raft in a floating condition even though the water seal may be broken between members 14 and 15 and skirting 23.

Figure 5:
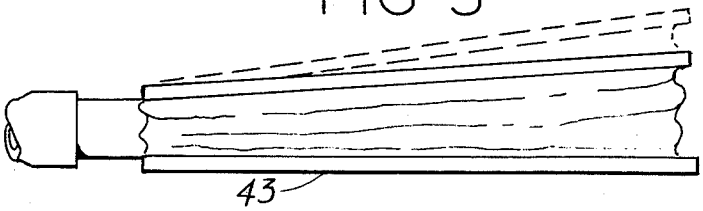
FIG. 5 is an elevational view of a fresh air supplying pump.

As shown in FIG. 6, the tube 30 is flexible and is compactible to a storage condition where the deck member and hull member engage one another. An air filling spout 32 is provided to enable inflation of the tube either manually or with pump 43 such as that illustrated in FIG. 5. Spout 32 includes a valve (not shown) of conventional form similar to an "inner tube" valve. Spout 32 extends into the occupant receiving area to facilitate inflation from within. In practice, the tube 30 may be inflated to bring the hull and deck members to a substantially expanded condition before the locking means is applied to hinge plates 18.

It may be noted in FIG. 3 that a ridge 34 is provided about the periphery of deck 14 that extends toward hull member 15. Likewise, hull member 15 includes a complementary ridge 38 that extends toward the deck member 14. Ridge 34 includes a convex surface 35 that faces hull member 15, and ridge 38 includes a complementary concave surface 37 that faces convex surface 35. These two surfaces come into engagement upon movement of the deck and hull members to the closed, compact condition. Further, in the expanded condition, these ridges help to hold the tube 30 in place about the periphery of the raft. When in the closed condition, the ridges 34 and 38 join about the exterior of the compacted raft, forming a peripheral wall to protect the inner components (tube 30, skirting 23, and hinge plates 18).

When my invention is to be utilized as a lifesaving raft, removable air vent tubes 42 are provided to extend outward and upwardly from apertures 40 on deck member 14 or hull member 15 whichever is up when the raft is afloat. The vent tubes enable fresh air to replenish the occupant receiving area between deck member 14 and hull member 15 and prevent entry of water into that area. Appropriate apertures are provided in deck 14 and hull 15 for two such air vent tubes 42 may be mounted on the surface of each member 14 and 15.

Figure 4:
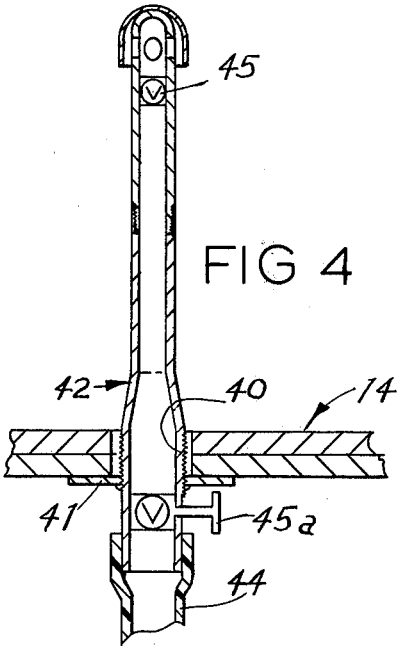
FIG. 4 is a section fragmentary view of a ventilator tube and valve in schematic form.

FIG. 4 illustrates one such air vent tube in substantial detail. As shown, the vent tubes are provided in two threadably connected sections. The bottom section includes an enlarged base so the smaller upper tube may be inserted through an appropriate aperture from within the occupant enclosure. Enough of the enlarged base extends into the occupant receiving area to threadably receive a disc plate 41. Plate 41 strengthens the deck from stress caused by wind or water against tubes 42. Any air vent tube 42 may be connected to an air pump 43, (FIG. 5) by a means of a hose 44. Appropriate float or gravitational actuated valves 45 are supplied in each vent tube 42. Such conventional valves serve to prevent entry of water but allow interchange or air. In addition a manual operable valve 45a is situated within the occupant receiving area. When in water, the bottom or hull vent receiving apertures are closed by threaded plugs (not shown). The pump 43 may be utilized to draw air into the occupant receiving area or to preferably push stale air out through one open vent 42 utilizing the remaining open vent to replenish the stale air with fresh outside air. An additional use of pump 43 as described above is to enable inflation of the tube 30 is disclosed above.

Figure 7:
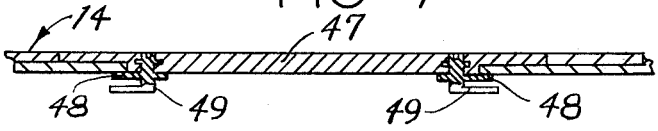
FIG. 7 is a fragmentary section view illustrating the hatch closure of the collapsible raft shown in FIG. 1.

FIGS. 1 and 7 illustrate a watertight or water sealable access hatch 47. Although hatch 47 is shown only on deck 14, it is also possible to provide an additional hatch on the hull member 15. Hatch 47 may be selectively removed to allow access to the occupant receiving area within and between hull member 15 and deck member 14. The hatch 47 on either member 14 or 15 provides inner locking clamp plates 48 and lever handles 49 that may be selectively utilized to tightly secure the hatch cover against deck member 14 or hull 15 as necessary to provide a watertight seal. A slight ridge (not shown) on the lower or inner surface of deck 14 where plates 48 make contact, may provide adequate tightness. As represented, the hatch will unlock completely upon 180 degrees rotation of handle 49. The hatch may be opened from the outside through provision of exposed sockets (screwdriver or hex key) in handles 49. Obviously, several such hatches may be utilized and the scale of the raft dimensions may be somewhat larger to with more than one hatch to provide access by more than one person.

Operation of the present invention may now be easily understood with reference in particular to FIGS. 3 and 6. While in storage, the raft will most probably be in the closed or compacted condition wherein deck member 14 is located closely adjacent hull member 15. FIG. 6 illustrates the raft in this condition. When the raft is to be utilized, the deck member may be lifted away from hull member 15 either by manual force or by inflating the tube 30. Inflation of tube 30 may be accomplished either manually or by utilizing the pump 43. Once in the expanded condition, the hinge plates 18 may be locked to hold the deck member and hull member in the open expanded condition simply by attaching the locking plates 21 to the successive hinge plates 18. With this simple procedure the raft is now ready for use. When utilized in the life raft configuration, the hatch 47 may be opened on either the hull or deck side, allowing access for occupants to enter between the hull and deck members. The occupant may then replace the water sealable hatch 47 and secure it by tightening the provided bolts 49. This step renders the raft invertible, protecting the occupant(s) both from water and exposure damages. Once inside, the occupant(s) may utilize pump 43 in conjunction with one of the air vents 42 to continuously replenish the air supply between the deck members.

Operation of the embodiment illustrated in FIG. 2 is similar to that of FIG. 1 only deck 14 includes a large open area having seats such as those shown at 50 provided therein. Seats 50 may be an integral part of the folding configuration or separate units to be fitted after the raft is expanded. In addition, a motor mount 51 may be provided as an attachment to enable the raft to be motor driven. The motor mount 51 would be enclosed by a watertight shroud 52 extending between hull 15 and deck 14.

The above descriptions have been given by way of example and are not intended to limit the scope of my invention. Only the following claims are to be taken as definitions of my invention.

What I claim is:

1. A collapsible raft, comprising:

a rigid deck member;

a rigid hull member;

hinge means connecting the deck and hull member for enabling relative movement of the hull and deck members between a compact condition wherein the hull and deck members are adjacent one another and an expanded condition wherein the hull and deck members are spaced apart to define an occupant receiving area;

a continuous flexible watertight skirt extending about and joining the hull and deck members along their respective peripheral edges to encompass the occupant receiving area; and an inflatable toroidal tube mounted between the hull and deck members adjacent the peripheral edges of the hull and deck members, exterior of the watertight skirt for moving the hull and deck members from the compact condition to the expanded condition as the tube is inflated and for providing added buoyancy and protecting the watertight skirt when the tube is inflated.

2. The raft set out in claim 1 wherein the deck member includes:

a water sealable access hatch enabling selective enclosure of the occupant receiving area between the deck and hull members; and a valved ventilator tube extending through the deck member into the enclosable occupant receiving area.

3. The raft set out in claim 2 wherein the hull member includes:

a water sealable access hatch enabling selective enclosure of the occupant receiving area between the deck and hull members; and a valved ventilation tube extending through the hull member into the enclosable occupant receiving area.

4. The raft set out in claim 2 further including pump means operatively connected to the ventilator tube for enabling evacuation of stale air from the occupant receiving area; and a second valved ventilator tube extending through the deck member and into the occupant receiving area for replenishing the area with fresh air as the state air is evacuated.

5. The raft set out in claim 3 further including pump means operatively connected to the ventilator tube for enabling evacuation of stale air from the occupant receiving area; and a second valved ventilator tube extending through the deck member and into the occupant receiving area for replenishing the area with fresh air as the stale air is evacuated.

6. The raft set out in claiam 1 the deck member includes a first peripheral ridge thereon facing the hull member;

a second peripheral ridge on the hull member facing the deck member engagable with the first peripheral ridge when in the collapsed condition of the raft to form a protective peripheral wall structure enclosing the hinge means watertight skirt, and toroidal tube.

7. The raft set out in claim 1 further including locking means mountable to the hinge means for locking the hinge means in the expanded condition.

* * * * *